US009333515B2

(12) United States Patent
Reiff et al.

(10) Patent No.: US 9,333,515 B2
(45) Date of Patent: May 10, 2016

(54) CENTRIFUGAL SEPARATOR HAVING AN INLET WITH WEAR RESISTANCE MEMBERS, AND A FEED ZONE ELEMENT WITH WEAR RESISTANCE MEMBERS

(75) Inventors: Henrik Reiff, Farum (DK); Egon Tandrup, Slangerup (DK)

(73) Assignee: ALFA LAVAL CORPORATE AB, Lund (SE)

( * ) Notice: Subject to any disclaimer, the term of this patent is extended or adjusted under 35 U.S.C. 154(b) by 221 days.

(21) Appl. No.: 13/977,383

(22) PCT Filed: Dec. 29, 2011

(86) PCT No.: PCT/EP2011/074258

§ 371 (c)(1),
(2), (4) Date: Sep. 6, 2013

(87) PCT Pub. No.: WO2012/089824

PCT Pub. Date: Jul. 5, 2012

(65) Prior Publication Data

US 2014/0005024 A1 Jan. 2, 2014

(30) Foreign Application Priority Data

Dec. 30, 2010 (DK) ..... 2010 70592

(51) Int. Cl.
*B04B 1/20* (2006.01)

(52) U.S. Cl.
CPC ..... *B04B 1/20* (2013.01); *B04B 1/2008* (2013.01); *B04B 2001/2033* (2013.01)

(58) Field of Classification Search
CPC B04B 1/20; B04B 1/2008; B04B 2001/2033; B04B 7/00; B04B 7/12
USPC ..... 494/53, 85
See application file for complete search history.

(56) References Cited

U.S. PATENT DOCUMENTS 3,428,246 A 2/1969 Finkelston
3,568,920 A * 3/1971 Nielsen ..... 494/53

(Continued)

FOREIGN PATENT DOCUMENTS

CN 2933585 Y 8/2007
CN 201524611 U * 7/2010

(Continued)

OTHER PUBLICATIONS

Search Report for corresponding Danish Application No. PA201070592, date of completion Aug. 10, 2011.

(Continued)

*Primary Examiner* — Charles Cooley
*Assistant Examiner* — Shuyi S Liu
(74) *Attorney, Agent, or Firm* — MKG, LLC

(57) ABSTRACT

A centrifugal separator includes an inlet chamber inside a conveyor body comprising a proximal cross wall and a distal cross wall. Longitudinal walls extend between the proximal cross wall and the distal cross wall. The proximal cross wall comprises a central opening and feed ports are present between adjacent longitudinal walls. The cross walls and longitudinal walls have internal surfaces. A feed path extends from the central opening, through the inlet chamber and out through the feed ports. Wear resistance members insertable through the feed ports fully screen the internal surfaces of the distal cross wall and the longitudinal walls from the feed path and comprise longitudinal wall members with at least one flange portion.

23 Claims, 6 Drawing Sheets

(56) References Cited

U.S. PATENT DOCUMENTS

| | | | | |
|---|---|---|---|---|
| 4,089,465 | A * | 5/1978 | Aeschbacher et al. | 220/592 |
| 5,244,584 | A * | 9/1993 | Schlieperskoetter | 210/787 |
| 7,247,133 | B2 | 7/2007 | Gronnegaard et al. | |
| 2004/0121892 | A1 | 6/2004 | Zonneveld et al. | |
| 2006/0025297 | A1 | 2/2006 | Gronnefaard et al. | |

FOREIGN PATENT DOCUMENTS

| | | | | |
|---|---|---|---|---|
| DE | 1815199 | A1 | 7/1969 | |
| DE | 4041868 | A1 * | 7/1992 | B04B 1/20 |
| EP | 0810032 | A1 | 3/1997 | |
| GB | 1144183 | | 3/1969 | |
| JP | 09239291 | A | 9/1997 | |
| JP | 2893526 | B1 | 5/1999 | |
| JP | 2005-519735 | A | 7/2005 | |
| RU | 2279925 | C2 | 7/2006 | |
| SU | 535966 | A1 | 11/1976 | |
| WO | 9312886 | A1 | 7/1993 | |
| WO | 03076078 | A1 | 9/2003 | |

OTHER PUBLICATIONS

International Search Report from PCT/EP2011/074258, dated Apr. 27, 2012.

Search Report for corresponding Chinese Application No. 201180063544.7, dated Dec. 18, 2013.

Decision on Grant issued in Russian Patent Application No. 2013135472, dated Sep. 19, 2014.

First Office Action for Japanese Patent Application No. 2013-546714, dated Sep. 25, 2014.

* cited by examiner

CENTRIFUGAL SEPARATOR HAVING AN INLET WITH WEAR RESISTANCE MEMBERS, AND A FEED ZONE ELEMENT WITH WEAR RESISTANCE MEMBERS

FIELD OF THE INVENTION

The present invention relates to a centrifugal separator, in particular to a decanter centrifuge, including a body rotatable in a direction of rotation around a preferably horizontal axis of rotation. The axis of rotation extends in a longitudinal direction of the body, said body includes a bowl and a screw conveyor arranged coaxially within the bowl, and being rotatable around the axis of rotation. The conveyor includes a core body carrying at least one helical winding, wherein an inlet chamber is provided in the core body. A separation chamber is radially outwards limited by the bowl and radially inwards limited by an outer circumference of the core body. The inlet chamber includes two cross walls, namely a proximal cross wall and a distal cross wall, and at least two longitudinal walls extending in the longitudinal direction between the proximal cross wall and the distal cross wall. The proximal cross wall includes a central opening for inlet of feed material into the inlet chamber, feed ports for inlet of feed material into the separation chamber from the inlet chamber being present between adjacent longitudinal walls, the cross walls and the longitudinal walls having internal surfaces within the outer circumference of the core body. The internal surfaces face the inlet chamber, a feed path extending from the central opening, through the inlet chamber and out through the feed ports.

The invention further relates to a feed zone element for mounting in a core body of a screw conveyor of a centrifugal separator.

BACKGROUND

WO-A-03/076078 discloses a decanter centrifuge in which wear reinforcement or wear resistance members are provided to protect the edge over which feed material flows from the inlet chamber into the separation chamber during operation of the centrifuge.

U.S. Pat. No. 3,568,920 discloses a decanter centrifuge having a screw conveyor built from parts bolted together. One such part is a monolithic insert constituting an inlet chamber, and bushings are providing ducts leading from the insert or inlet chamber to the separation chamber between the screw conveyor and the bowl. The insert and the bushings are preferably made from wear resistant material such as steel suited for through hardening. The insert and the bushings are relatively easily exchanged in case they are worn out by dismantling the bolted-together screw conveyor.

JP-A-9 239291 discloses a decanter centrifuge with a screw conveyor comprising an inlet chamber and longitudinal openings between the inlet chamber and the separation chamber. The inlet chamber is divided into an inlet zone and a drain zone by a septum or partition. Inside the inlet zone (and the drain zone) "inclined plane components" are provided for preventing material from depositing inside the inlet chamber. The "inclined plane components" may be made from wear resistant material or the internal surfaces thereof may comprise a layer of wear resistant material. An end wall of the inlet zone is covered by a wear resistant plate.

The present inventors have observed that during operation of a decanter centrifuge with certain feed materials wear may occur throughout the inlet chamber.

SUMMARY

According to aspects disclosed herein, there is provided a decanter that includes wear resistance members insertable through the feed ports fully screen the internal surfaces of the distal cross wall and the longitudinal walls from the feed path, and in that the wear resistance members comprise a longitudinal wall member at each longitudinal wall. The longitudinal wall member comprises a curved longitudinal portion screening at least a part of the internal surface of the longitudinal wall, and at least one flange portion screening a part of the distal cross wall. It should be understood that the curve of the curved longitudinal portion is overall curved and in one embodiment comprises curved sections as well as rectilinear sections. In one embodiment, the wear resistance members fully screen the internal surface of the proximal cross wall from the feed path. It is envisaged that the inlet chamber by application of the invention will not need maintenance throughout the life time of the screw conveyor due to surface wear.

To be insertable through the feed ports the wear resistance members have dimensions allowing their insertion through the feed ports.

Preferably the curved longitudinal portion of the longitudinal member screens the internal surface of the longitudinal wall, and preferably the longitudinal wall member comprises another flange portion screening a part of the proximal cross wall.

In one embodiment flange portions of adjacent longitudinal wall members engage with each other. Hereby is obtained that a number of similar wear resistance members corresponding to the number of longitudinal walls may be used to cover practically the entire internal surface of the inlet chamber with the possible exception of the central areas of the cross walls.

In another embodiment the wear resistance members comprise cross wall members positioned between adjacent longitudinal wall members, said cross wall members engaging with the flange portions of the adjacent longitudinal wall members. Hereby is obtained that the individual wear resistance members may be smaller which may facilitate the production thereof.

The wear resistance members preferably comprise a central member at least at one of the cross walls the axis of rotation extending centrally through the central member. The central member engages with adjacent flange portions or cross wall members. This provides for symmetry of the wear resistance members covering the longitudinal walls and cross walls beside the centres of the latter.

In one embodiment a tubular central member extends through the central opening, said tubular central member carrying an integrated flange inside the inlet chamber and a blocking member outside the inlet chamber. In an embodiment wherein the positions of the wear resistance members are locked by mutual engagement between the wear resistance members the tubular central member may be used as a final brick and a blocking member carried by the tubular central member may thus prevent removal of the entirety of wear resistance members.

In another embodiment a wear resistance member comprises a cross wall portion screening a portion of a cross wall and two curved longitudinal portions screening complementary portions of adjacent longitudinal walls.

In one embodiment, the positions of wear resistance members are locked by mutual engagement between wear resistance members, and the position of at least one wear resistance member is locked by a blocking member, to obtain a mechanical or geometrical locking of the wear resistance members.

In one embodiment, the joints between adjacent wear resistance members are filled with a wear resistant filler, to avoid the abrasive feed material from penetrating between the wear resistance members to the internal surfaces of the inlet chamber.

In one embodiment, gaps between on one hand the internal surfaces of the cross walls and the longitudinal walls and on the other hand the wear resistance members are filled with a filler, such as an adhesive, to further secure the wear resistance members and to prevent the wear resistance members.

In one embodiment, adjacent edges of mutually engaging wear resistance members are overlapping each other. This facilitates the geometric locking of the wear resistance members and the prevention of abrasive feed material penetrating between adjacent wear resistance members.

In one embodiment, the wear resistance members are made of or comprise a wear resistant material, such as tungsten carbide.

The object is fulfilled according to the invention by a feed zone element for mounting in a core body of a screw conveyor of a centrifugal separator, especially a decanter centrifuge, comprising a body rotatable in a direction of rotation around a preferably horizontal axis of rotation, said axis of rotation extending in a longitudinal direction of the body. The body includes a bowl. The screw conveyor is arranged coaxially within the bowl, and is rotatable around said axis of rotation. The screw conveyor includes the core body carrying at least one helical winding, a separation chamber being radially outwards limited by said bowl and radially inwards limited by an outer circumference of said core body. An inlet chamber is provided by the feed zone element, the inlet chamber includes two cross walls, namely a proximal cross wall and a distal cross wall, and at least two longitudinal walls extending in the longitudinal direction between the proximal cross wall and the distal cross wall. The proximal cross wall comprises a central opening for inlet of feed material into the inlet chamber, feed ports for inlet of feed material into the separation chamber from the inlet chamber being present between adjacent longitudinal walls. The cross walls and the longitudinal walls have internal surfaces within the outer circumference of the core body. The internal surfaces face the inlet chamber. A feed path extends from the central opening, through the inlet chamber and out through the feed ports wherein wear resistance members insertable through the feed ports fully screen the internal surfaces of the distal cross wall and the longitudinal walls from the feed path, and in that the wear resistance members comprise a longitudinal wall member at each longitudinal wall, said longitudinal wall member comprising a curved longitudinal portion screening at least a part of the internal surface of the longitudinal wall, and at least one flange portion screening a part of the distal cross wall. Such a feed zone element may be retrofitted in an existing centrifuge.

BRIEF DESCRIPTION OF THE DRAWINGS

In the following the invention will be explained in further detail by way of examples of embodiments with reference to the attached schematic drawing, in which.

DETAILED DESCRIPTION

Figure 2:
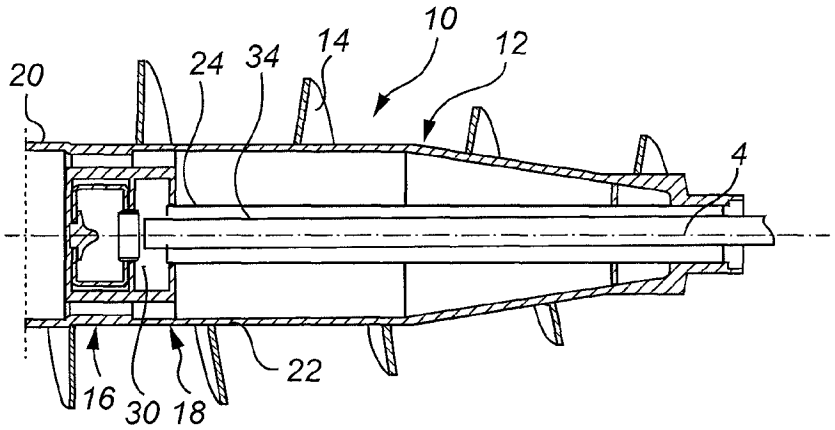
FIG. 2 shows a section of screw conveyor shown in FIG. 1.
Figure 1:
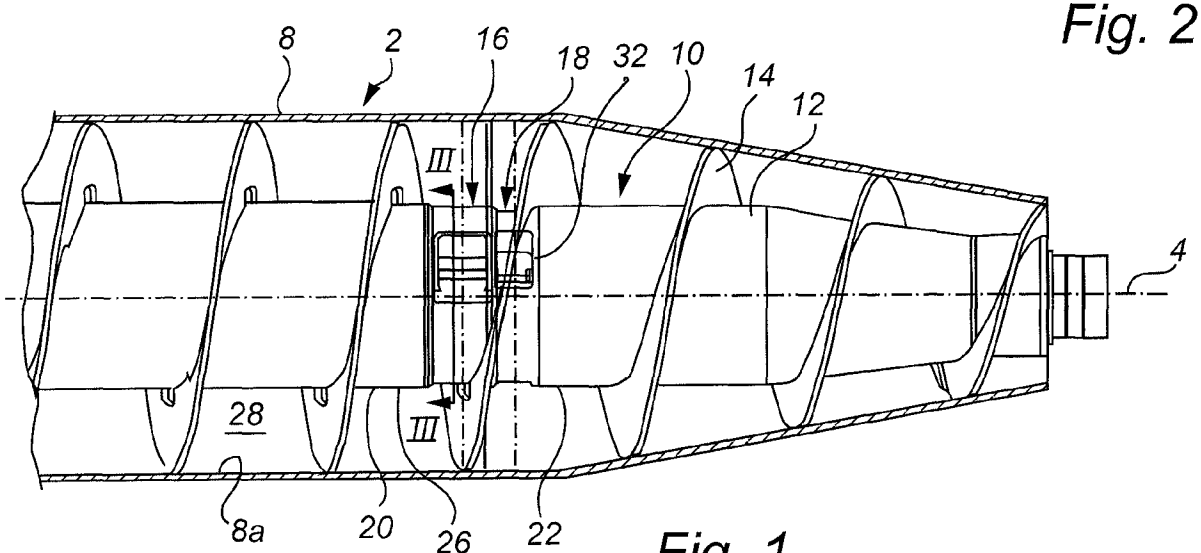
FIG. 1 shows a part of a decanter centrifuge.
Figure 3:
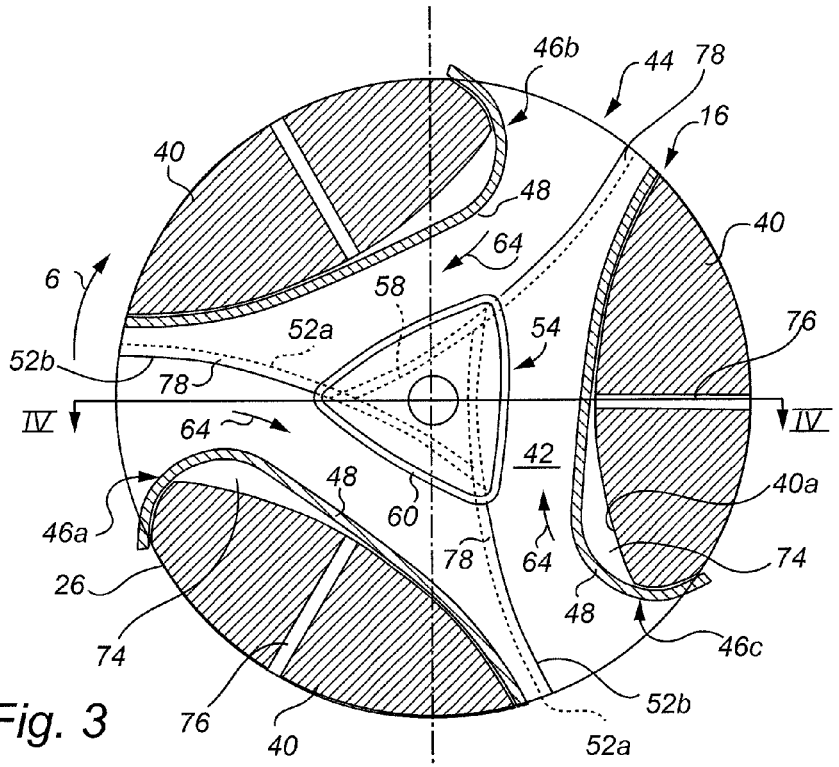
FIG. 3 shows a cross section of the screw conveyor along line III-III in FIG. 1.

FIGS. 1 and 2 show a centrifugal separator, namely a decanter centrifuge, comprising a body 2 rotatable around an axis of rotation 4 in a direction of rotation 6 (cf. FIG. 3). The body 2 comprises a bowl 8 and a screw conveyor 10, the screw conveyor 10 having a core body 12 carrying a helical winding 14. The core body 12 includes a feed zone element with an inlet zone 16 and a drain zone 18, which is attached to tubular portions 20 and 22. The drain zone 18 is attached to an outer inlet pipe 24. Between an inner wall 8*a* of the bowl 8 and an outer or external circumference 26 of the core body 12 the body 2 includes a separation chamber 28. The drain zone 18 includes a drain chamber 30 with a drain opening 32 providing fluid connection between the drain chamber 30 and the separation chamber 28. A stationary inner inlet pipe 34 extends from the outside of the rotating body 2, through the outer inlet pipe 24 and partly through the drain chamber 30. The function of the inlet zone and the drain zone is explained below.

Figure 4:
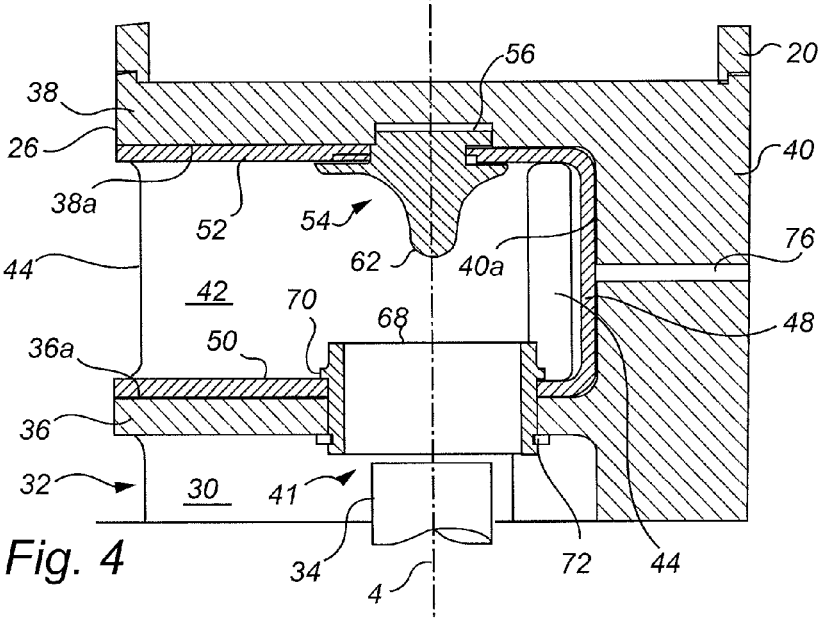
FIG. 4 shows a section along line IV-IV in FIG. 3.

The inlet zone 16, which is shown also in FIGS. 3 and 4, comprises two cross walls, namely a proximal cross wall 36 and a distal cross wall 38, and a number of longitudinal walls 40, the number being three in the present embodiment, as shown in FIG. 3. The terms "proximal" and "distal" attached to the cross walls 36 and 38 refer to the end of the inner inlet pipe 34 inside the drain chamber 30, which end constitutes during operation a source of feed material to be treated in the separation chamber 28. A central opening 41 is provided in the proximal cross wall 36.

Between the cross walls 36, 38 and the longitudinal walls 40 an inlet chamber 42 is provided within the outer circumference 26 of the core body 12. The central opening 41 provides fluid communication between the drain chamber 30 and the inlet chamber 42. Between adjacent longitudinal walls 40 feed ports 44 are present providing fluid communication between the inlet chamber 42 and the separation chamber 28. Inside the inlet chamber 42 the cross walls 36, 38 and the longitudinal walls 40 have internal surfaces 36*a*, 38*a* and 40*a*, respectively.

In use feed material is introduced centrally through the inner inlet pipe 34, the feed material following a path through the central opening 41 into the inlet chamber 42 through this and into the separation chamber 28 through the feed ports 44. Any feed material that spills from the end of the inner inlet pipe instead of reaching the inlet chamber or splash-back from the inlet chamber is received by the drain chamber 30 and exits to the separation chamber 28 through the drain opening 32.

According to the invention at least the internal surface 38*a* of the distal cross wall 38 and the internal surfaces 40*a* of the longitudinal walls 40 are screened or shielded from the path or flow of the feed material in the inlet chamber 42 to avoid erosion of those surfaces due to contact with the possibly abrasive feed material. In the present embodiment also the internal surface 36*a* of the proximal cross wall 36 is shielded.

Thus screening or shielding wear resistance members are provided as follows.

Longitudinal wall members 46, shown in FIGS. 3 to 6, each comprises a curved longitudinal portion 48 extending along and screening the entire internal surface 40*a* of one of the longitudinal walls 40, and two flange portions, namely a proximal flange portion 50 and a distal flange portion 52 extending along and screening portions of the internal surface 36*a* of the proximal wall 36 and the internal surface 38*a* of the distal wall 38, respectively. It is noted that in the present embodiment the curved longitudinal portion 48 comprises two curved sections 48*a*, 48*b* and an intermediate rectilinear section 48*c*.

The flange portions 50 and 52 comprise similarly curved edge sections 50*a*, 50*b* and 52*a*, 52*b*, respectively, whereby three longitudinal wall members 46 may be assembled in the configuration shown in FIGS. 3 and 4 so that the concave curved edge section 52*a* of one longitudinal wall member 46*a* engages with the convex curved edge section 52*b* of a first adjacent longitudinal wall member 46*b* and the convex curved edge section 52*b* of said one longitudinal wall member 46*a* engages with the concave curved edge section 52*a* of a second adjacent longitudinal wall member 46*c*. Correspondingly, though not shown, the concave curved edge section 50*a* of said one longitudinal wall member 46*a* engages with the convex curved edge section 50*b* of the first adjacent longitudinal wall member 46*b* and the convex curved edge section 50*b* of said one longitudinal wall member 46*a* engages with the concave curved edge section 50*a* of the second adjacent longitudinal wall member 46*c*.

Figure 5:
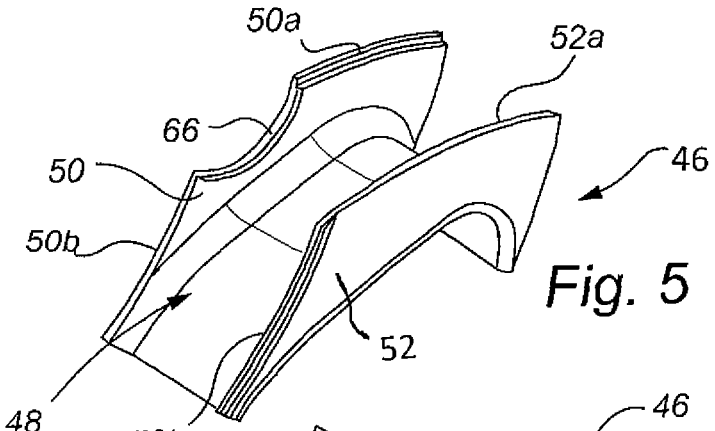
FIG. 5 shows a perspective view of wear resistance member.
Figure 6:
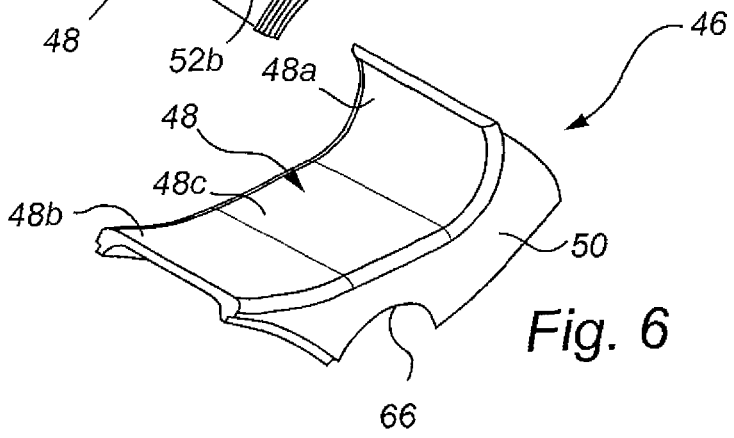
FIG. 6 shows another perspective view of the wear resistance member.
Figure 7:
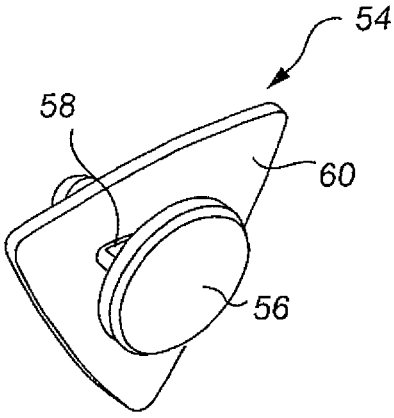
FIG. 7 shows a perspective view of a distal central member.
Figure 8:
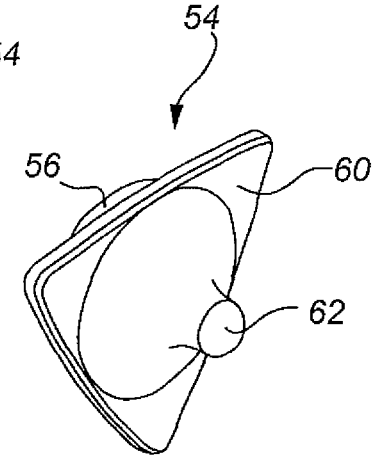
FIG. 8 shows another perspective view of the distal central member.

It is shown in FIGS. 5 and 6 that the curved edge sections 50*a*, 50*b*, 52*a*, 52*b* are stepped so that the respective engaging curved edge sections overlap as seen in FIG. 3.

As shown in FIG. 3 a substantially triangular central area is left uncovered by the longitudinal wall members 46*a*, 46*b*, 46*c* between these members. To cover this triangular residual area the wear resistance members comprise a distal central member 54, which is symmetrical relative to the axis of rotation 4. The distal central member 54 comprises a flat circular cylindrical portion 56, which is accommodated in a recess in the distal cross wall 38 as seen in FIG. 4, a first substantially triangular portion 58 the sides of which correspond to and engage with the curved edge portions 52*a* of the respective longitudinal wall members 46, and a substantially triangular larger portion 60 with a central projection 62 extending into the inlet chamber 42. The flat cylindrical portion 56 has a diameter of a size which prohibits removal of the distal central member 54 when the wear resistance members are assembled as shown in FIG. 3. The triangular larger portion 60 has a size so that it covers the joints between the first triangular portion 58 and the longitudinal wall members 46*a*, 46*b*, 46*c*.

The orientation and curvature of the curved edge sections 50*a*, 50*b*, 52*a*, 52*b* of the longitudinal wall members 46 are adapted so that the longitudinal wall members may be slid from the outside of the core body 12 into the positions shown in FIG. 3 as indicated by arrows 64. Placing the distal central member 54 with its circular cylindrical portion 56 accommodated in the recess in the distal cross wall before the longitudinal wall members 46 are slid into their positions indicated in FIG. 3 provides for mounting the distal central member 54 in a geometrically locked position.

The proximal flange portions 50 has a circularly curved recess 66 between the curved edge sections 50*a* and 50*b* said recesses 66 providing an opening aligned with the central opening 41 in the proximal cross wall 36 when the longitudinal wall members 46 are in the assembled position shown in FIGS. 3 and 4. As shown in FIG. 4 a tubular central member 68 with an integral flange 70 is placed in the opening provided by the recesses 66 and the central opening 41, the tubular central member 68 being inserted through the inlet chamber 42. When in place as shown in FIG. 4 the tubular central member 68 is locked on one side by a retaining ring 72, which is fitted in a circumferential groove as shown, and on the other side by the integral flange 70. Due to engagement with the proximal flange portions 50 at the recesses 66 the tubular central member 68 prohibits sliding the longitudinal wall members 46 in the directions opposite to the directions indicated by the arrows 64, thus prohibiting removal of the longitudinal wall members 46 from the positions shown in FIG. 3.

Thus the positions of the distal central member 54 and the longitudinal wall members 46 are locked by mutual engagement between wear resistance members whereas the position of the tubular central member 68 is locked by a blocking member, namely the retainer ring 72.

As shown in FIG. 3 gaps 74 are present between the longitudinal wall members 46 and the internal surfaces in the inlet chamber especially between the curved longitudinal portions 48 and the internal surfaces 40*a* of the longitudinal walls 40. Channels 76 are provided through the longitudinal walls 40 for injection of a filler material such as two-component glue, e.g. comprising epoxy, into said gaps 74. The filler will assist retaining the wear resistance members in the positions shown and keep the wear resistance members from rattling.

In one embodiment, the joints 78 between the wear resistance members, especially between the longitudinal wall members 46 are filled by a wear resistant filler such as an epoxy based filler comprising wear resistant grains or particles. Such fillers are known and are applied in a plastic state following which they cure into a harder state.

It is noted that the wear resistance members i.e. the longitudinal wall members 46 in the embodiment shown in FIGS. 3 and 4 extend a little outside the inlet chamber 42.

The material of the wear resistance members 46, 48 and 54 is preferably tungsten carbide or a material with corresponding wear resistance properties.

Though the longitudinal walls 40 are shown in FIG. 3 to be solid it should be understood that they may be hollow e.g. by comprising recesses extending the axial length of the longitudinal walls on either side of the channel 76.

Figure 9:
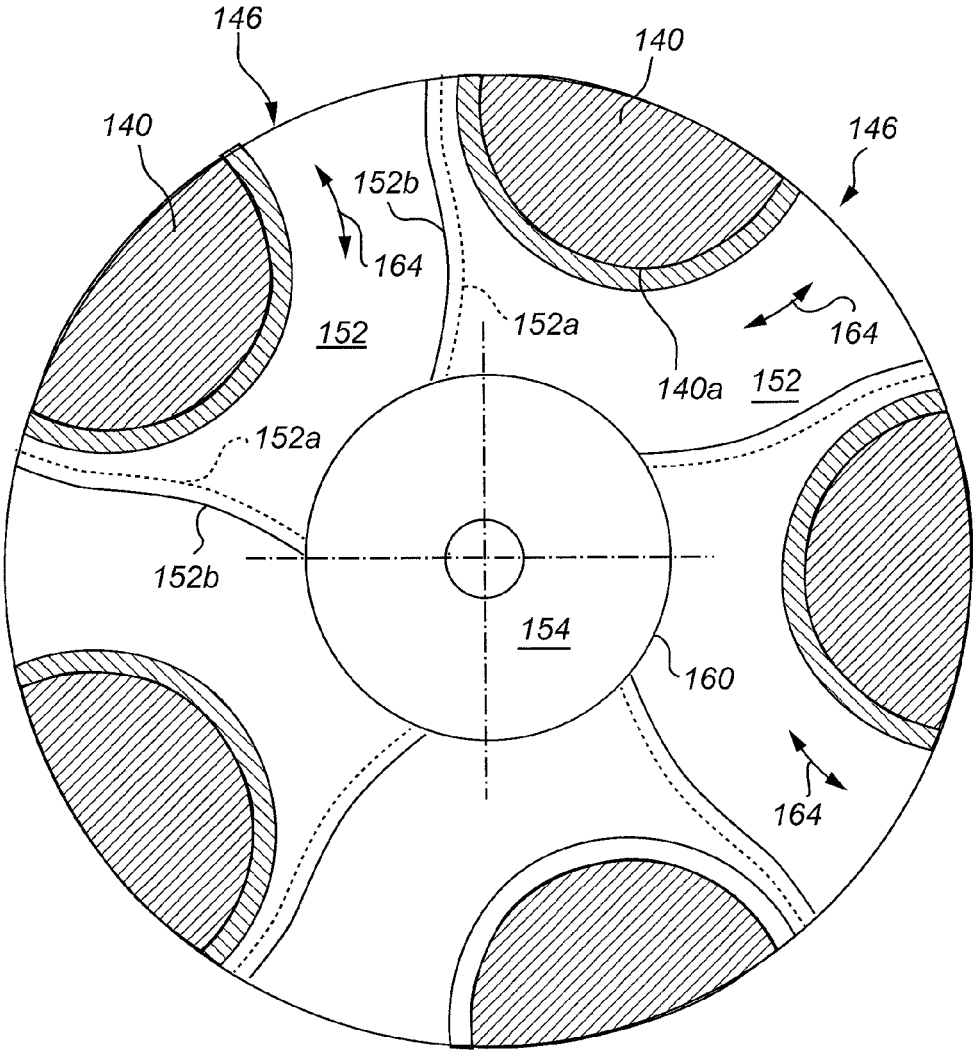
FIG. 9 shows a cross section corresponding to FIG. 3 of another embodiment.

FIG. 9 shows a cross section corresponding to FIG. 3 of a variant comprising five longitudinal walls 140 having internal surfaces 140*a* following circular arcs in the cross section shown. Features or items of the embodiment of FIG. 9 which corresponds to features or items of the embodiment of FIGS. 3 to 8 are given corresponding reference numerals with a prefixed number 1. A distal central member 154 has in this embodiment a circular larger portion 160 rather than a triangular one as the embodiment of FIGS. 3, 4, 7 and 8. Apart form a small central area shielded by the distal central member 154, distal flange portions 152 of longitudinal wall members 146 together shields the distal cross wall, which thus is not seen in FIG. 9 being hid behind the distal flange portions 152 and the distal central member 154. The distal flange portions 152 comprise curved edge sections 152*a* and 152*b* whereby curved section 152*a* of one longitudinal wall member engage with and overlap curved section 152*b* of an adjacent longitudinal wall member as shown. It should be understood that the longitudinal wall members 146 comprise correspondingly shaped proximal flange portions. Similar to the function of the embodiment of FIGS. 3-6 the shapes of the curved edge sections allow the longitudinal wall members 146 to be slid into and out of the positions shown in FIG. 9 as indicated by arrows 164, and similarly a tubular central member, not shown, locks the positions of the longitudinal wall members 146. The circular arc shape of the internal surfaces 140*a* and correspondingly of the longitudinal wall members 146 provides a production advantage in that two longitudinal wall members may be produced from one blank using to a large extent lathe turning.

Figure 10:
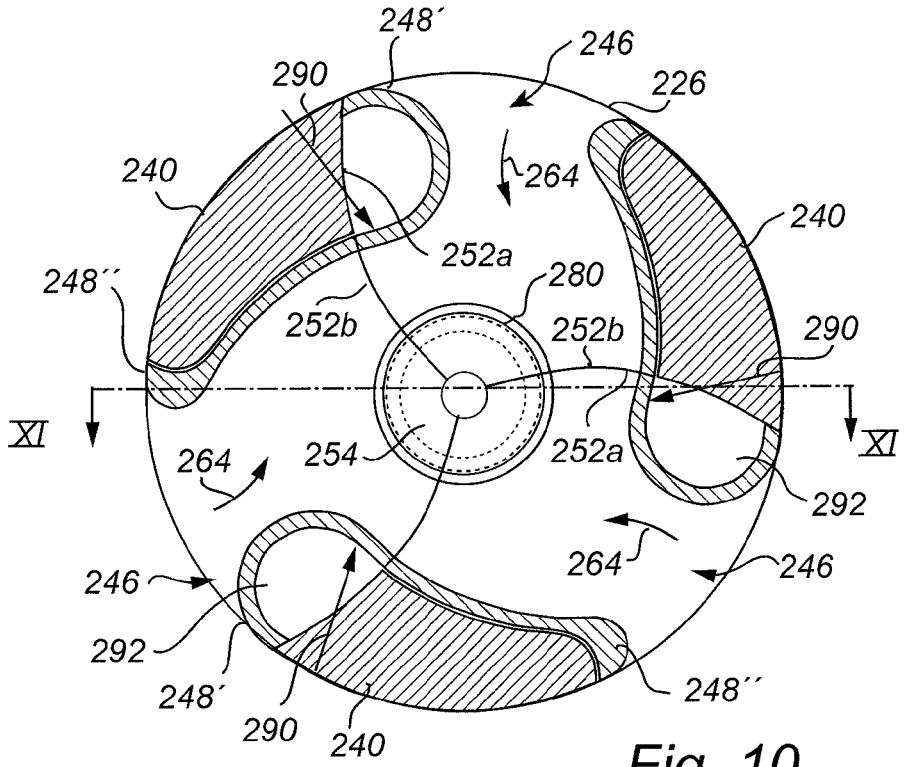
FIG. 10 shows a cross section corresponding to FIG. 3 of yet another embodiment.
Figure 11:
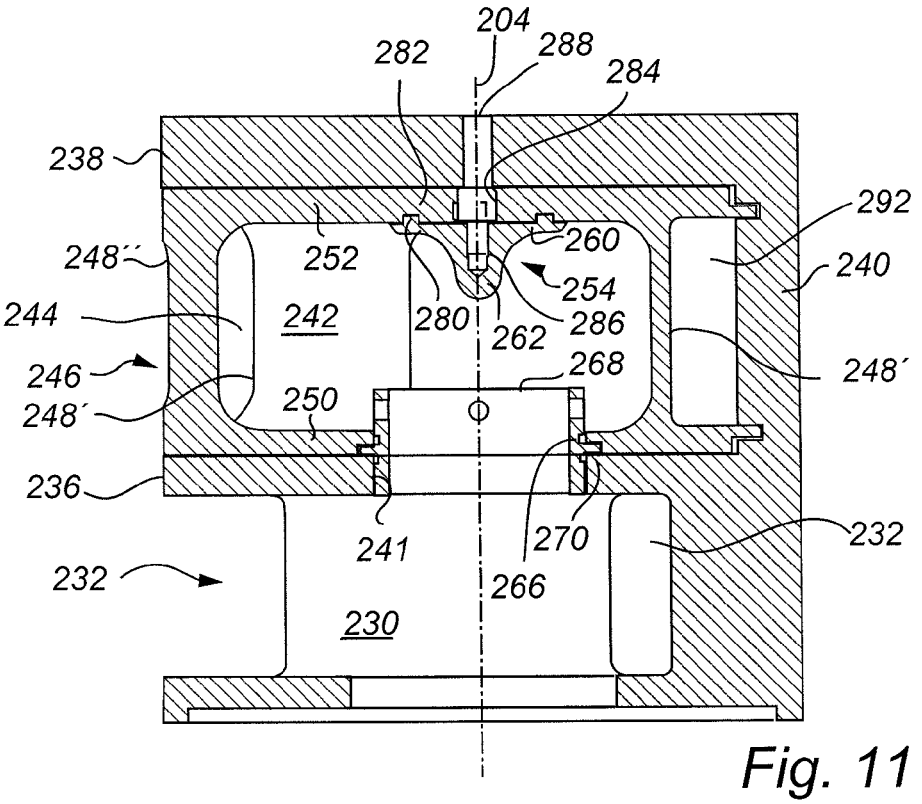
FIG. 11 shows a section along line XI-XI in FIG. 10.

FIGS. 10 and 11 show an embodiment in which a wear resistance member comprises a cross wall portion screening a portion of a cross wall and two curved longitudinal portions screening complementary portions of adjacent longitudinal walls. Features or items of the embodiment of FIGS. 10 and 11, which corresponds to features or items of the embodiment of FIGS. 3 to 8 are given corresponding reference numerals with a prefixed number 2. Thus the embodiment of FIGS. 10 and 11 comprises a drain chamber 230 with drain openings 232, an inlet chamber 242 with feed ports 244, a proximal cross wall 236 between the drain chamber 230 and the inlet chamber 242, a distal cross wall 238 opposite the proximal cross wall 236 and longitudinal walls 240 extending between the proximal cross wall 236 and the distal cross wall 238. The screw conveyor comprising the drain chamber 230 and the inlet chamber 242 has an axis of rotation 204.

Wear resistance members of this embodiment comprise longitudinal wall members 246 comprising a distal flange portion 252 and a proximal flange portion 250, which have similar contours apart from the area close to the axis of rotation 204 when in the mounted position shown in FIGS. 10 and 11. Between the proximal flange portion and the distal flange portion two complementary curved longitudinal wall portions 248' and 248" are extending each shielding a part of an adjacent longitudinal walls 240, complementary curved longitudinal wall portions 248' and 248" of two adjacent longitudinal wall members 246 thus shielding together a longitudinal wall 240 from the path or flow of feed material through the inlet chamber 242, the two curved longitudinal wall portions 248' and 248" shielding complementary portions of the longitudinal wall 240.

The wear resistance members further comprise a distal central member 254 and a tubular central member 268.

The tubular central member 268 has an integral flange 270, which abuts the proximal cross wall 236 and is overlapped by adjacent edges of the proximal flange portions 250. During mounting of the wear resistance members of this embodiment the tubular central member 268 is mounted before the longitudinal wall members 246, e.g. by being threaded into a central opening 241 of the proximal cross wall 236.

The distal central member 254 has a round flat portion 260 with a central projection 262 extending into the inlet chamber 242. On the side opposite the central projection 262 the round flat portion 260 carries an annular projection 280 extending, when mounted as shown in FIG. 11, into a corresponding annular groove 282 in the distal flange portions 252, each of which comprises a sector of the annular groove. The distal central member 254 further comprises a central threaded hole 286 open to the side opposite the central projection 262.

The distal flange portion 252 of each longitudinal wall member 246 has similarly curved edge sections 252*a* and 252*b* having a convex and a concave curve, respectively, the curves extending to an outer circumference 226 of the distal cross wall 238. The curves are circular arcs in the embodiment shown in FIG. 10. The proximal flange portion 250 has curved edge sections similar to the curved edge sections of the distal flange portion 252. At the centre, i.e. in the vicinity of the axis of rotation 204 and coaxially therewith, circularly curved recesses 266 and 284 are provided in the proximal flange portions 250 and the distal flange portions 252, respectively, to give room for the tubular central member 268 and a fastening member, not shown, respectively. It is noted that the diameter of the circularly curved recess 266 is much larger than the diameter of the circularly curved recess 284.

When mounting the wear resistance members of the embodiment shown in FIGS. 10 and 11 the tubular central member 268 is mounted first, as mentioned above, whereafter the longitudinal wall members 246 are inserted as shown by arrows 264 into the positions shown in FIG. 10. Finally the distal central member 254 is inserted through the inlet chamber 242 to have its annular projection 280 accommodated in the annular groove 282 whereafter the distal central member is secured by a screw inserted through a central hole 288 in the distal cross wall 238, through the area of the circularly curved recess 284 and into the threaded hole 286 in the distal central member 254. The engagement between the annular projection 280 and the annular groove 282 secures the longitudinal wall members 246. Thus the tubular central member 268 and the longitudinal wall members 240 are locked in their positions by engagement between wear resistance members, whereas the position of the distal central member 254 is locked by the screw inserted in the threaded hole 286, said screw serving as a blocking member.

It is possible to secure further the longitudinal wall members 246 by providing a threaded hole in each of the longitudinal walls and inserting a screw through said hole to have the end of the screw abut against a rear surface of the curved longitudinal portion 248' as indicated by arrows 290.

It is noted that in this embodiment relatively large gaps or closed hollow spaces 292 are present between the longitudinal walls 240 and the curved longitudinal portions 248'. These hollow spaces are preferably filled with a foam material to avoid that the hollow spaces are filled by feed material penetrating between the wear resistance members. In general gaps between the wear resistance members and the cross walls and longitudinal walls and the joints between the wear resistance members are preferably filled as discussed in relation to the embodiment shown in FIGS. 3 to 8.

Figure 12:
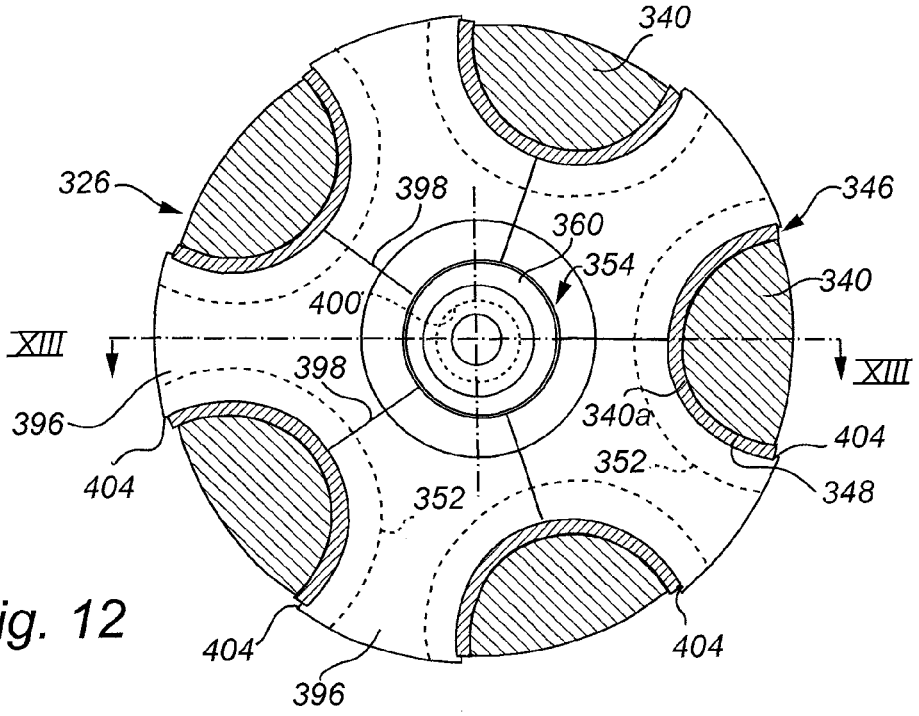
FIG. 12 shows a cross section corresponding to FIG. 3 of a fourth embodiment.
Figure 13:
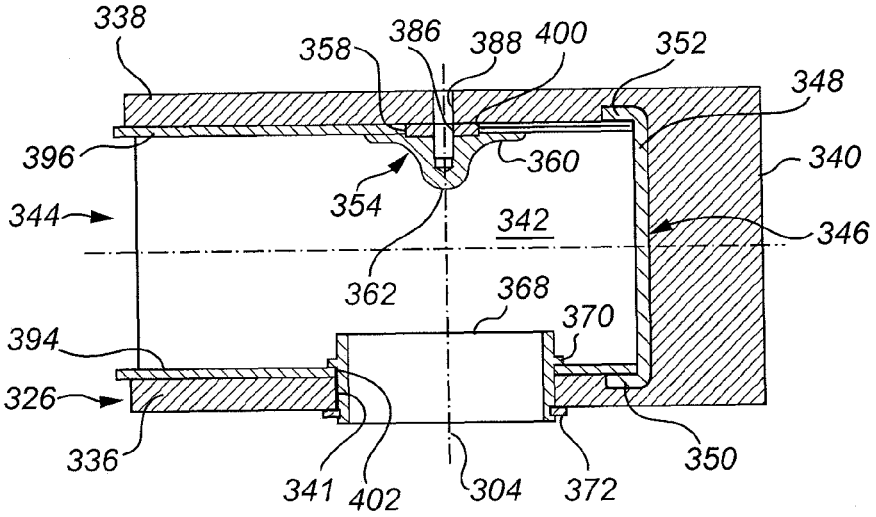
FIG. 13 shows a section along line XIII-XIII in FIG. 12.

FIGS. 12 and 13 show an embodiment in which the wear resistance members comprise cross wall members positioned between adjacent longitudinal wall members, said cross wall members engaging with the flange portions of the adjacent longitudinal wall members. Features or items of the embodiment of FIGS. 12 and 13, which corresponds to features or items of the embodiment of FIGS. 3 to 8 are given corresponding reference numerals with a prefixed number 3.

Like the embodiment shown in FIG. 9 the embodiment shown in FIGS. 12 and 13 comprises five longitudinal walls 340 having internal surfaces 340*a* following circular arcs in the cross section shown in FIG. 12. The drain zone being omitted from FIGS. 12 and 13 these figures show an inlet chamber 342 defined by a proximal cross wall 336, a distal cross wall 338 and the longitudinal walls 340, feed ports 344 being present between adjacent longitudinal walls 340. The proximal cross wall 336 has a central opening 341 coaxial with an axis of rotation 304 for inlet of feed material from an inlet pipe, not shown, into the inlet chamber 342, as indicated in FIG. 2.

Like in the previous embodiments wear resistance members are provided for shielding the internal surfaces of the inlet chamber 342 from the path or flow of feed material flowing through the central opening 341 into the inlet chamber 342, through said chamber and out through the feed ports 344. In this embodiment the wear resistance members comprise longitudinal wall members 346 with curved longitudinal portions 348 and relatively small similar proximal and distal flange portions 350 and 352 at respective ends thereof. Like in the previous embodiments the curved longitudinal portions 348 extend substantially rectilinear between the flange portions 350, 352 along the longitudinal walls 340 in the axial direction of the axis of rotation 304.

In the proximal and the distal cross wall 336, 338 recesses are provided to accommodate the respective proximal and distal flange portions 350, 352 as it is shown in FIG. 13.

Between the longitudinal wall members 346 proximal and distal cross wall members 394, 396 are provided shielding respectively the proximal and the distal cross wall 336, 338. The cross wall members 394, 396 are flat wear resistance members engaging each other along rectilinear edges 398 (see FIG. 12 which shows only the distal cross wall members 394), which are stepped whereby the cross wall members 394, 396 form overlapping joints along the rectilinear edges 398.

The cross wall members extend radially from a central circular recess to a position a little beyond an outer circumference 326 of the distal and proximal cross wall 338, 336. The reason for the radial outwardly extend will be explained below.

The distal cross wall members 394 extends from a central recess 400. A distal central member 354 comprising a flat circular cylindrical portion 358, a substantially larger portion 360 with a central projection 362 and a threaded hole 386 opening in the flat cylindrical portion 358 is provided to cover the area around the central recess 400. Thus the flat circular cylindrical portion 362 is accommodated in the central recess 400 when the wear resistance members are mounted as shown in FIGS. 12 and 13. The distal cross wall 336 comprises a central hole 388.

The proximal cross wall members 396 extends from a central recess 402, which has a larger diameter than the central recess 400 and is congruent with the central opening 341. A tubular central member 368 having an integral flange 370 extends through the central recess 402 and the central opening 341 and is locked by a retaining ring 372 like in the embodiment of FIGS. 3 to 8.

The cross wall members 394, 396 extend to the curved longitudinal portions 348 of the longitudinal wall members 346 overlapping the respective flange portions 350, 352.

Radially outwardly from the axis of rotation 304 the cross wall members 394, 396 extend beyond the corresponding radial extend of the curved longitudinal portions 348, and the cross wall members 394, 396 have circumferential projections 404 extending a little distance circumferentially along the curved longitudinal portions 348 radially outwards thereof to prevent rotation of the longitudinal wall members 346 around the longitudinal walls 340. Alternatively or supplementary to the circumferential projections the edge of the cross wall member may be bend to extend axially past the adjacent edge of the respective flange portion 350, 352 of the longitudinal wall member.

When mounting the wear resistance members of this embodiment the longitudinal wall members 346 are initially put into their positions shown in FIGS. 12 and 13 by being rotatably slid around the respective longitudinal wall 340 along the circular internal surface 340*a* thereof. Subsequently the proximal and the distal cross wall members 394, 396 are inserted. The proximal cross wall members 396 are secured by the tubular central member 368 being inserted through the inlet chamber 342 into the central recess 402 and the central opening 341. After the insertion the tubular central member 368 is secured by the retaining ring 372 being mounted. The distal cross wall members 394 are secured by the distal central member 354 being inserted through the inlet chamber 342 to have its flat circular cylindrical portion 358 accommodated in the central recess 400 the flat circular cylindrical portion 358 abutting the distal cross wall 338. The distal central member 354 is secured by a screw, not shown, inserted through the central hole 388 into the threaded hole 386. The cross wall members 394, 396 are secured in the radial outward direction by the longitudinal walls 340 and the longitudinal wall members 346. The cross wall members 394, 396 are retained in the axial direction by the flange 370 of the tubular central member 368 and by the distal central member 354. Preferably the gaps between the wear resistance members and the internal surfaces of the cross walls and the longitudinal walls are filled with an adhesive further securing the wear resistance members, and preferably joints between wear resistance members are filled by a wear resistant filler like in the embodiment according to FIGS. 3 to 8.

Although this invention has been shown and described with respect to the detailed embodiments thereof, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A centrifugal separator, comprising:

a body rotatable in a direction of rotation around a preferably horizontal axis of rotation, said axis of rotation extending in a longitudinal direction of said rotating body, said rotating body comprising a bowl and a screw conveyor arranged coaxially within said bowl, said screw conveyor being rotatable about said axis of rotation, said screw conveyor comprising a core body carrying at least one helical winding;

wherein an inlet chamber is provided in the core body;

a separation chamber being radially outwards limited by said bowl and radially inwards limited by an outer circumference of said core body, said inlet chamber comprising two cross walls, namely a proximal cross wall and a distal cross wall, and at least two longitudinal walls extending in the longitudinal direction between the proximal cross wall and the distal cross wall, said proximal cross wall comprising a central opening for inlet of feed material into the inlet chamber, feed ports for inlet of feed material into the separation chamber from the inlet chamber being present between adjacent longitudinal walls, the cross walls and the longitudinal walls having internal surfaces within the outer circumference of the core body, said internal surfaces facing the inlet chamber;

a feed path extending from the central opening, through the inlet chamber and out through the feed ports; and a plurality of wear resistance members insertable through the feed ports fully screen the internal surfaces of the distal cross wall and the longitudinal walls from the feed path, and the plurality of wear resistance members comprise a longitudinal wall member at each longitudinal wall, said longitudinal wall member comprising a curved longitudinal portion screening at least a part of the internal surface of the longitudinal wall, and at least a first flange portion screening a part of the distal cross wall.

2. A centrifugal separator according to claim 1, wherein the plurality of wear resistance members fully screen the internal surface of the proximal cross wall from the feed path.

3. A centrifugal separator according to claim 1, wherein the curved longitudinal portion of the longitudinal wall member screens the internal surface of the longitudinal wall.

4. A centrifugal separator according to claim 1, wherein the longitudinal wall member comprises a second flange portion screening a part of the proximal cross wall.

5. A centrifugal separator according to claim 1, wherein respective first flange portions of adjacent longitudinal wall members engage with each other.

6. A centrifugal separator according to claim 1, wherein the plurality of wear resistance members comprise distal cross wall members positioned between adjacent longitudinal wall members, said distal cross wall members engaging with the first flange portions of the adjacent longitudinal wall members.

7. A centrifugal separator according to claim 5, wherein the plurality of wear resistance members comprise a central member at the distal cross wall, the axis of rotation extending centrally through said central member, said central member engaging with adjacent first flange portions.

8. A centrifugal separator according to claim 1, wherein a wear resistance member comprises at least said first flange portion screening a portion of the distal cross wall and two complimentary curved longitudinal portions screening complementary portions of adjacent longitudinal walls, whereby the internal surface of each longitudinal wall is fully screened from the fed path by complementary curved longitudinal portions of either of two adjacent wear resistance members.

9. A centrifugal separator according to claim 7, wherein the positions of wear resistance members adjacent the central members are locked by engagement with said central member.

10. A centrifugal separator according to claim 1, wherein the position of a wear resistance member is locked by a blocking member.

11. A centrifugal separator according to claim 1, wherein joints between adjacent wear resistance members are filled with a wear resistant filler.

12. A centrifugal separator according to claim 1, wherein gaps between the internal surfaces of the cross walls and the longitudinal walls and the wear resistance members are filled with a filler.

13. A centrifugal separator according to claim 1, wherein individual wear resistance members of the plurality of wear resistance members comprise edges and respective edges of mutually adjacent wear resistance members are overlapping each other.

14. A feed zone element for mounting in a core body of a screw conveyor of a centrifugal separator, wherein an inlet chamber is provided by said feed zone element, said inlet chamber comprising two cross walls, namely a proximal cross wall and a distal cross wall, and at least two longitudinal walls extending in the longitudinal direction between the proximal cross wall and the distal cross wall, said proximal cross wall comprising a central opening for inlet of feed material into the inlet chamber, feed ports for inlet of feed material into a separation chamber outside the feed zone element from the inlet chamber being present between adjacent longitudinal walls, the cross walls and the longitudinal walls having internal surfaces, said internal surfaces facing the inlet chamber, a feed path extending from the central opening, through the inlet chamber and out through the feed ports, and wherein a plurality of wear resistance members insertable through the feed ports fully screen the internal surfaces of the distal cross wall and the longitudinal walls from the feed path, and the plurality of wear resistance members comprise a longitudinal wall member at each longitudinal wall, said longitudinal wall member comprising a curved longitudinal portion screening at least a portion of the internal surface of the longitudinal wall, and at least a first flange portion screening a part of the distal cross wall.

15. A centrifugal separator according to claim 4, wherein respective second flange portions of adjacent longitudinal wall members engage with each other.

16. A centrifugal separator according to claim 4, wherein the plurality of wear resistance members comprise proximal cross wall members positioned between adjacent longitudinal wall members, said proximal cross wall members engaging with the second flange portions of the adjacent longitudinal wall members.

17. A centrifugal separator according to claim 15, wherein the plurality of wear resistance members comprise a tubular central member at the proximal cross wall, the axis of rotation extending centrally through said tubular central member, said tubular central member engaging with adjacent second flange portions.

18. A centrifugal separator according to claim 6, wherein the wear resistance members comprise a central member at the distal cross wall, the axis of rotation extending centrally through said central member, said central member engaging with adjacent distal cross wall members.

19. A centrifugal separator according to claim 16, wherein the wear resistance members comprise a tubular central member at the proximal cross wall, the axis of rotation extending centrally through said tubular central member, said tubular central member engaging with adjacent proximal cross wall members.

20. A centrifugal separator according to claim 19, wherein the tubular central member extends through the central opening, said tubular central member carrying an integrated flange inside the inlet chamber and a blocking member outside the inlet chamber, said tubular member locking the position of adjacent wear resistance members.

21. A centrifugal separator according to claim 18, wherein the positions of wear resistance members adjacent the central member are locked by engagement with said central member.

22. A centrifugal separator according to claim 1, wherein gaps between the internal surfaces of the cross walls and the longitudinal walls and the wear resistance members are filled with an adhesive.

23. A centrifugal separator according to claim 17, wherein the tubular central member extends through the central opening, said tubular central member carrying an integrated flange inside the inlet chamber and a blocking member outside the inlet chamber, said tubular member locking the position of adjacent wear resistance members.

* * * * *